US009453346B2

(12) United States Patent
Yau

(10) Patent No.: US 9,453,346 B2
(45) Date of Patent: Sep. 27, 2016

(54) SURFACE COVERING CONNECTION JOINTS

(71) Applicant: BEST WOODS INC.

(72) Inventor: Paul Yau, Napa, CA (US)

(73) Assignee: Best Woods Inc., Napa, CA (US)

( * ) Notice: Subject to any disclaimer, the term of this patent is extended or adjusted under 35 U.S.C. 154(b) by 0 days.

(21) Appl. No.: 14/435,123

(22) PCT Filed: Sep. 15, 2014

(86) PCT No.: PCT/US2014/055704

§ 371 (c)(1),
(2) Date: Apr. 10, 2015

(87) PCT Pub. No.: WO2015/039048

PCT Pub. Date: Mar. 19, 2015

(65) Prior Publication Data

US 2015/0284964 A1 Oct. 8, 2015

Related U.S. Application Data

(60) Provisional application No. 61/960,326, filed on Sep. 16, 2013, provisional application No. 61/998,281, filed on Jun. 23, 2014.

(51) Int. Cl.
*E04F 15/02* (2006.01)
*E04C 2/12* (2006.01)
(Continued)

(52) U.S. Cl.
CPC ..... *E04F 15/02038* (2013.01); *B27M 3/04* (2013.01); *E04C 2/12* (2013.01); *E04F 15/02044* (2013.01); *E04F 15/042* (2013.01);
(Continued)

(58) Field of Classification Search
CPC ..... E04F 2201/0115; E04F 2201/026; E04F 2201/0176; E04F 2201/0161; E04F 2201/023; E04F 2201/028; E04F 2201/0107; E04F 15/02; E04F 15/04; E04F 15/02038; E04F 15/02033; E04F 2015/02122; E04F 15/02044; E04F 15/042; E04F 15/045; Y10T 403/7094; F16B 5/0016; B27M 3/04; E04C 2/12; E04C 2002/004
USPC ..... 52/588.1
See application file for complete search history.

(56) References Cited

U.S. PATENT DOCUMENTS 1,128,896 A 7/1872 Murray
1,386,554 A 8/1921 Dalglish
(Continued)

FOREIGN PATENT DOCUMENTS

EP 0141453 B1 4/1988
EP 1085138 A2 3/2001
EP 2528736 B1 9/2014

*Primary Examiner* — Brent W Herring
(74) *Attorney, Agent, or Firm* — Kilpatrick Townsend & Stockton LLP

(57) ABSTRACT

The present technology relates to connection joints for surface coverings which includes but is not limited to floor coverings and building panels. Embodiments of the present technology include connection joints that are strong and allow for the use of less material than is needed for tongue and groove connection joints. In embodiments related to floor coverings, these advantages are accomplished by reducing total thickness of a floor plank while increasing the thickness of the wear layer relative to the overall thickness of the floor plank and still be able to maintain a structurally strong connection joint.

12 Claims, 7 Drawing Sheets

(51) Int. Cl.
*E04F 15/04* (2006.01)
*B27M 3/04* (2006.01)
*E04C 2/00* (2006.01)

(52) U.S. Cl.
CPC ..... *E04F 15/045* (2013.01); *E04C 2002/004* (2013.01); *E04F 2015/02122* (2013.01); *E04F 2201/0107* (2013.01); *E04F 2201/023* (2013.01); *E04F 2201/028* (2013.01)

(56) References Cited

U.S. PATENT DOCUMENTS 1,720,841 A 7/1929 Jones
1,986,739 A 1/1935 Mitte
2,008,244 A 7/1935 Crooks
2,039,536 A 5/1936 Johnson
2,152,694 A 4/1939 Hoover
2,221,475 A 11/1940 Goldschmidt, Sr.
2,246,377 A 6/1941 Mattes
2,270,808 A 1/1942 Kaye
2,419,047 A 4/1947 Young
2,427,879 A 9/1947 Robertson et al.
2,679,468 A 5/1954 Pitman
2,732,597 A 1/1956 Contratto
D180,051 S 4/1957 Waldman
2,836,863 A 6/1958 Denker
3,186,130 A 6/1965 Gray
3,200,553 A * 8/1965 Frashour ..... E04F 15/04 52/592.4
3,228,162 A 1/1966 Gregoire
3,640,191 A 2/1972 Hendrich
3,807,113 A 4/1974 Turner
3,968,610 A 7/1976 Medow
4,044,520 A 8/1977 Barrows
4,065,895 A 1/1978 Shank et al.
4,242,390 A 12/1980 Nemeth
4,644,720 A 2/1987 Schneider
4,700,524 A 10/1987 Addison
4,807,416 A 2/1989 Parasin
4,833,855 A 5/1989 Winter, IV
4,899,514 A 2/1990 Brookhart, Jr.
5,040,348 A * 8/1991 King ..... E04F 13/0864 52/533
5,437,934 A * 8/1995 Witt ..... B32B 13/10 428/191
5,735,099 A 4/1998 Anderson
5,797,237 A * 8/1998 Finkell, Jr. ..... E04F 15/04 52/586.1
5,899,251 A 5/1999 Turner
5,928,735 A 7/1999 Padmanabhan et al.
5,957,626 A 9/1999 Bostwick et al.
5,976,644 A 11/1999 Sanaee et al.
6,006,486 A * 12/1999 Moriau ..... B27F 1/06 52/586.1
6,247,285 B1 6/2001 Moebus
6,276,413 B1 8/2001 Hill
6,332,733 B1 12/2001 Hamberger et al.
6,397,548 B1 6/2002 Martin et al.
6,490,836 B1 * 12/2002 Moriau ..... B27F 1/06 52/586.1
6,519,912 B1 * 2/2003 Eckmann ..... B27M 3/0053 52/589.1
6,601,359 B2 * 8/2003 Olofsson ..... E04F 13/16 52/588.1
6,655,432 B1 12/2003 Yabe
6,722,809 B2 4/2004 Hamberger et al.
6,763,643 B1 * 7/2004 Mårtensson ..... E04F 15/02 52/403.1
6,786,019 B2 * 9/2004 Thiers ..... B44C 1/24 52/586.1
6,862,857 B2 * 3/2005 Tychsen ..... E04F 15/02 52/582.1
6,865,856 B2 * 3/2005 Kim ..... E04F 15/02 52/387
6,895,881 B1 5/2005 Whitaker
6,968,663 B2 * 11/2005 Thiers ..... E04F 15/02 52/589.1
7,021,012 B2 4/2006 Zeng et al.
7,093,399 B2 8/2006 Thiers et al.
7,131,242 B2 * 11/2006 Martensson ..... E04B 1/6129 52/578
7,155,871 B1 1/2007 Stone et al.
7,270,497 B2 9/2007 Von Langsdorff
7,454,875 B2 11/2008 Pervan et al.
7,458,191 B2 12/2008 Stone
7,617,645 B2 * 11/2009 Moriau ..... B27F 1/06 52/384
7,617,791 B2 11/2009 Gribble
7,637,068 B2 * 12/2009 Pervan ..... B27F 1/02 52/582.1
7,665,263 B2 2/2010 Yau
7,694,477 B2 4/2010 Kuelker
7,726,089 B2 6/2010 Moriau et al.
7,748,183 B2 7/2010 Myers et al.
7,823,359 B2 11/2010 Pervan
7,827,751 B2 11/2010 Plante
7,849,655 B2 12/2010 Chen et al.
7,856,785 B2 12/2010 Pervan
7,913,730 B2 3/2011 Schaffeld
7,926,239 B2 * 4/2011 Hahn ..... E04F 15/02033 52/589.1
8,037,656 B2 10/2011 Liu et al.
8,071,193 B2 12/2011 Windmoller
8,146,318 B2 4/2012 Palsson et al.
8,166,723 B2 5/2012 Moriau et al.
8,171,691 B1 5/2012 Stone
8,176,698 B2 * 5/2012 Lewark ..... E04F 15/02 428/151
8,191,328 B1 6/2012 Liu
8,205,403 B2 6/2012 Myers et al.
8,234,831 B2 8/2012 Pervan
8,261,507 B2 9/2012 Hahn et al.
8,268,110 B2 9/2012 Pien
8,302,367 B2 11/2012 Schulte
8,353,140 B2 1/2013 Pervan et al.
8,381,476 B2 2/2013 Hannig
8,402,709 B2 * 3/2013 Martensson ..... E04B 1/6129 52/582.1
8,429,870 B2 4/2013 Chen et al.
8,438,814 B2 5/2013 Thiers et al.
8,733,063 B2 5/2014 Song et al.
8,833,028 B2 9/2014 Whispell et al.
9,032,685 B2 * 5/2015 Martensson ..... E04B 1/6129 52/591.1
2002/0020127 A1 * 2/2002 Thiers ..... E04F 15/02 52/403.1
2002/0100242 A1 * 8/2002 Olofsson ..... E04F 13/16 52/588.1
2002/0100540 A1 8/2002 Savitski et al.
2003/0046891 A1 3/2003 Colada et al.
2005/0005558 A1 1/2005 Bolduc
2005/0144881 A1 * 7/2005 Tate ..... E04F 15/10 52/578
2005/0241255 A1 * 11/2005 Kim ..... E04F 15/02 52/591.4
2005/0247022 A1 11/2005 Poupart et al.
2006/0078666 A1 4/2006 Smith et al.
2006/0123729 A1 * 6/2006 Myers ..... E04F 13/185 52/519
2006/0185299 A1 8/2006 Poupart
2007/0193179 A1 8/2007 Risi
2007/0245663 A1 * 10/2007 Hahn ..... E04F 15/02033 52/506.01
2009/0151291 A1 6/2009 Pervan
2009/0211176 A1 8/2009 Bennett et al.
2010/0269438 A1 * 10/2010 Myers ..... E04F 13/185 52/302.1
2011/0296780 A1 * 12/2011 Windmoller ..... B32B 3/06 52/309.1
2013/0014464 A1 1/2013 Risi et al.
2013/0255174 A1 10/2013 Stafford et al.

* cited by examiner

SURFACE COVERING CONNECTION JOINTS

BACKGROUND OF THE INVENTION

1. Field of the Invention

The technology of the present application generally relates to a system for providing a connecting joint along adjacent joint edges of two building panels. More particularity, the technology provides new and improved connection joints that provide strength and use less material than existing connection joints. Thus, this technology is especially well suited for use in joining thin floor covering panels.

2. Description of Related Art

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also correspond to implementations of the claimed technology. The term "plank" is used in a functional sense indicating a generally elongated structural member.

A common type of surface covering is wood flooring. Wood flooring may consist of a plurality of adjacent wooden floor planks affixed to a sub-floor. FIG. 1A shows a cross-section of a wooden floor plank 100, the floor plank may be comprised of a top side 102, a bottom side 104, two edges 106, 108 along the longitudinal sides of the plank, and two ends. The cross-section shown is perpendicular to the two edges and includes a tongue and grove connection joint. The tongue 110 is positioned on a portion of a first edge 106 of a floor plank and the groove 112 is positioned on a second edge 108 of the floor plank. A method of installing floor planks with tongue and groove connection joints includes affixing the tongue side of a first floor plank to a sub-floor 114 with a fastener 116, for example a nail, and positioning the groove side of a second floor plank to receive a portion of the tongue of the first floor plank as is shown in FIG. 1B. In the examples the sub-floor 114 and fastener 116 are shown for illustrative purposes and in practice the sub-floor may be thicker relative to the floor plank 100 than is shown. Further, the fastener may be relatively longer than shown, for example three fifths of the total length of the fastener may be in the sub-floor with two fifths of the length extending through the floor plank. In this method the groove side of the second floor plank is not fastened directly to the sub-floor and is prevented from moving in a vertical direction away from the sub-floor by the tongue of the first floor plank. To create an area of floor covering, this step is repeated with each tongue side of the previously installed floor plank and a groove side of a newly installed floor plank.

Floor planks with tongue and groove connection joints require substantial thickness in order to form a strong joint and a large portion of each floor plank remains as residual waste when the floor plank is replaced. The top portion of the cross-sections of the floor planks in FIG. 1B comprises a wear layer 118 located between the top surface 102 and a bottom portion 120 of the planks. When floor covering is damaged, for example through normal wear and tear, the floor covering is resurfaced using a device such as a sander. Each time the resurfacing process removes about one millimeter of wood material from the top surface of the wear layer 118 creating a new smooth top surface, the overall thicknesses of the wear layer and the plank are reduced. After refinishing the planks several times the wear layer is exhausted leaving only the bottom portion 120 of the planks and an exposed head of the fastener 116, as shown in FIG. 1C. At this point the floor covering needs to be replaced because it can no longer be refinished because no wear layer remains to be resurfaced and further the exposed head of the fastener may damage a resurfacing device. As is shown is FIG. 1C about two thirds of the original plank remains after the wear layer is exhausted and therefore a large portion of the wood of the original floor plank is thrown away. It is therefore desirable to provide surface coverings that use less material to make and have less residual waste.

To manufacture a thin floor plank with a tongue and groove connection joint either, one or more of the tongue, bottom portion of the groove, or top portion of the groove must be made thinner in order to reduce the overall thickness of the floor plank. It is more beneficial to reduce the thickness of the tongue and/or bottom portion of the groove to reduce overall plank thickness because reducing the top portion of the groove will reduce the thickness of the wear layer of the floor plank and therefore reduce the life span of the floor plank. Reducing the thickness of the tongue and/or bottom portion of the groove results in a connection joint that is not a mechanically strong joint because one or more of the tongue, or bottom portion of the groove will be too thin and will become flimsy and likely to crack or break if the joint is stressed. Therefore it is desirable to provide a connection joint that allows overall thickness of the board to be reduced while maintaining a large proportion of wear layer and maintaining a mechanically strong connection joint.

Surface coverings tend to be exposed to changes in temperature and humidity which may affect characteristics of the coverings. For example, wooden surface coverings in a high humidity climate may start to swell and cause cupping or even buckling problems. In a low humidity dry climate wooden floor planks may shrink. Shrinking may cause lateral movements perpendicular to the direction of the grain. Under this condition, in a nail-down application example the un-affixed side of a first plank may move away from an affixed side of a second plank, which results in a lateral separation between the planks. This lateral separation may cause loosening of an un-affixed side of a plank causing a hazard or damage to the floor covering. It is therefore desirable to provide a surface covering with a connection joint that reduces buckling and loosening caused by swelling and shrinking conditions.

SUMMARY OF THE INVENTION

The present technology relates to connection joints for surface coverings which includes but is not limited to floor coverings and building panels. Embodiments of the present technology include connection joints that are strong and allow for the use of less material than is needed for tongue and groove connection joints. In embodiments related to floor coverings, these advantages are accomplished by reducing total thickness of a floor plank while increasing the thickness of the wear layer relative to the overall thickness of the floor plank and still be able to maintain a structurally strong connection joint.

In embodiments the wear layer comprises a larger portion of the thickness of a plank than planks with tongue and groove connection joints. For example 30%-70% compared to ~30% with tongue and groove. In embodiments the same thickness of wear layer may be provided with a thinner overall plank thickness. A thinner overall plank thickness significantly improves the log yield, the amount of area, e.g. square footage, of surface coverings that a single log can produce. Therefore embodiments of the technology may save thousands of trees per year. Further, because less volume of raw material is needed to produce the same square footage of surface covering products, manufacturing costs will be reduced, as well as transportation costs and drying process costs, which may allow manufacturers to be more competitive by offering consumers superior products at a lower costs than competitors, which is beneficial to both manufacturers and consumers.

The higher percentage of wear layer may also reduce the amount of residual waste because the amount of material left after the floor plank can no longer be refinished is significantly less. The higher percentage of wear layer may also be implemented to increase the lifetime of the plank by increasing the thickness of the wear layer without increasing the overall thickness of the plank.

These increases in wear layer thickness are accomplished with improved connection joints. Embodiments of connection joints provide equal or greater structural strength than existing connection joints, such as tongue and groove, while using less material. This advantage is achieved by using unique shapes that will be described in detail below. Embodiments further provide connection joints that maintain strength and surface evenness when conditions cause expansion (e.g. swelling) and contraction (e.g. shrinking) of the panels. This is achieved through unique shapes of connection joints which include gaps, swell reliefs, and one or more overlapping surfaces that will be described below.

Other aspects and advantages of the present invention can be seen on review of the drawings, the detailed description and the claims, which follow.

DETAILED DESCRIPTION

Figure 1A:
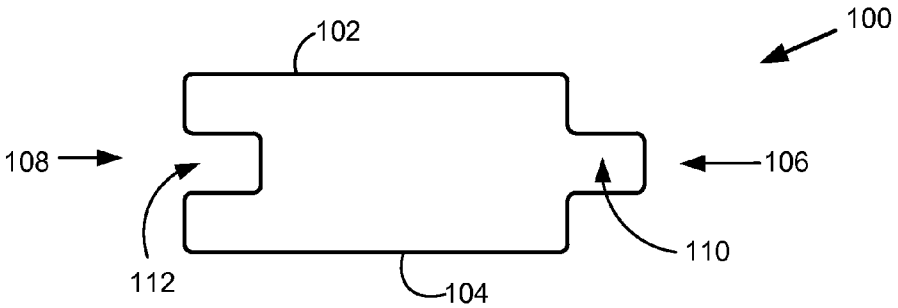
FIG. 1A shows a cross-section of a floor plank with a tongue and groove connection joints.
Figure 1B:
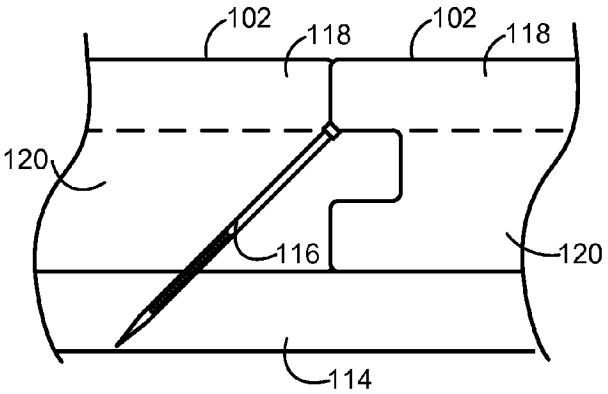
FIG. 1B shows a cross-section of two floor planks with tongue and groove connection joints affixed to a sub-floor prior to refinishing.
Figure 1C:
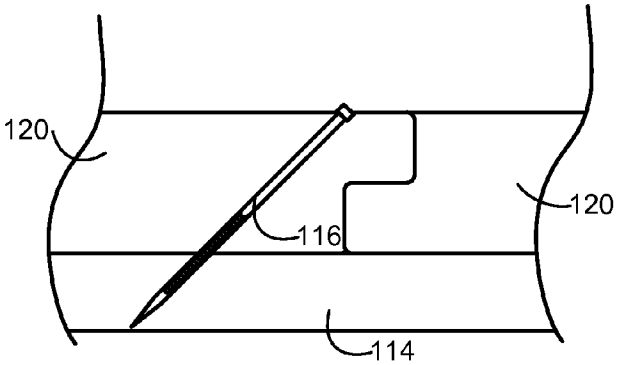
FIG. 1C shows a cross-section of two floor planks with tongue and groove connection joints affixed to a sub-floor after refinishing several times and needing to be replaced and thrown away.

The following description of the technology will typically be with reference to specific structural embodiments and methods. It is to be understood that there is no intention to limit the invention to the specifically disclosed embodiments and methods but that the invention may be practiced using other features, elements, methods and embodiments. Embodiments are described to illustrate the present technology, not to limit the scope of the invention, which is defined by the claims. Those of ordinary skill in the art will recognize a variety of equivalent variations on the description that follows. Like elements in various embodiments are commonly referred to with like reference numerals.

Figure 2A:
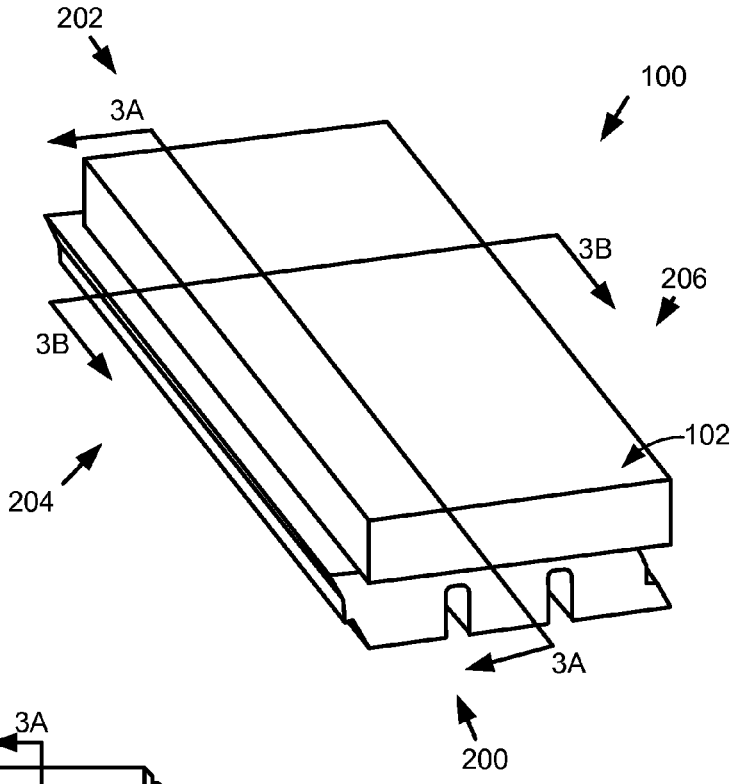
FIG. 2A shows a perspective view of a floor plank including embodiments of connection joints.
Figure 2B:
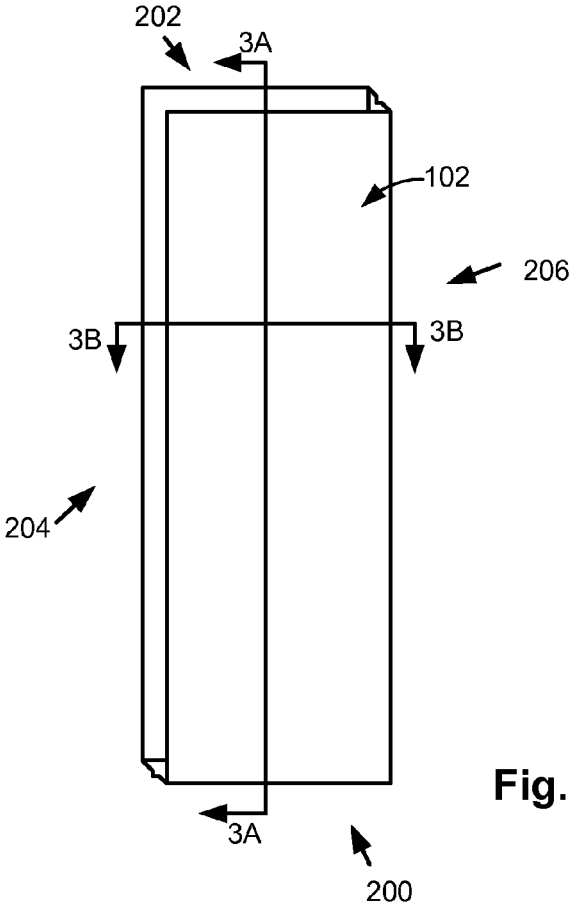
FIG. 2B shows a top view the floor plank shown in FIG. 2A.

FIG. 2A shows a view of a floor plank 100. A plurality of floor planks may be used as a floor covering over an area of a sub-floor. The floor plank shown includes two embodiments of connection joints, a wedge and a wedge shaped slot connection joint on the ends 200, 202 and a wedge with a cleat and a wedge shaped slot with a cleft connection joint along the edges 204, 206 of the plank 100. FIG. 2B shows a top view of the floor plank 100 in FIG. 2A including two labeled cross-sections, 3A-3A and 3B-3B.

Figure 3A:
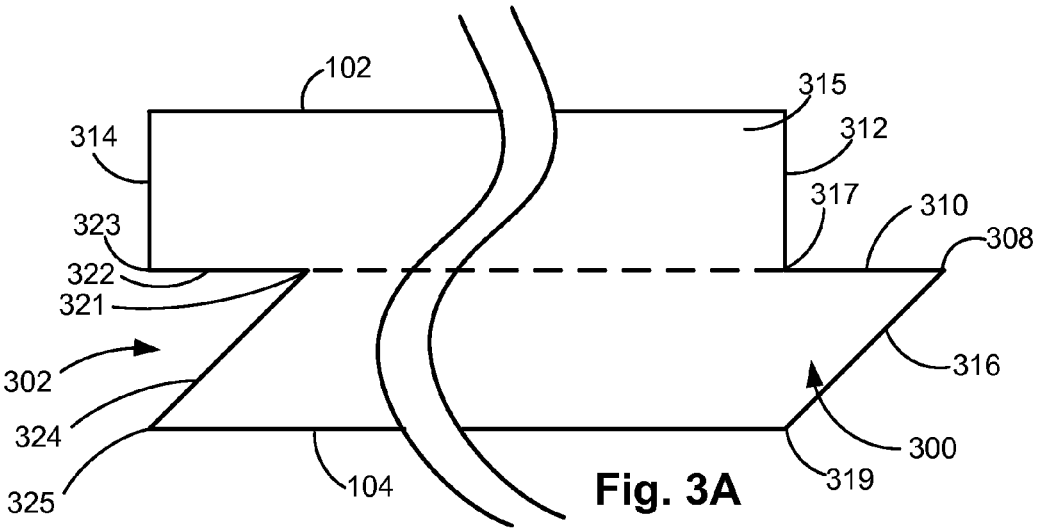
FIG. 3A shows the 3A-3A cross-section of the floor plank of FIG. 2B including edges with an embodiment of a connection joint.
Figure 3B:
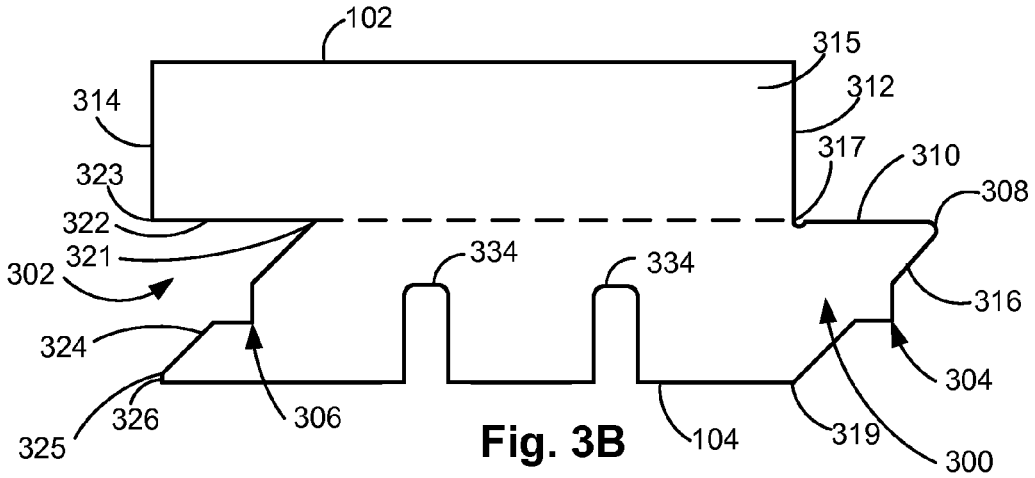
FIG. 3B shows the 3B-3B cross-section of the floor plank of FIG. 2B including edges with an embodiment of a connection joint.

FIG. 3A shows cross-section 3A-3A, omitting the central portion of the plank, including an embodiment of a wedge and slot connection joint. The embodiment of the connection joint in FIG. 3A includes a first side including a wedge 300 and a second side including a wedge shaped slot 302. FIG. 3B shows cross-section 3B-3B, including an embodiment of a connection joint. The embodiment of the connection joint in FIG. 3B includes a first side including a wedge 300 and a cleat 304 and a second side including a wedge shaped slot 302 and a cleft 306.

Figure 4A:
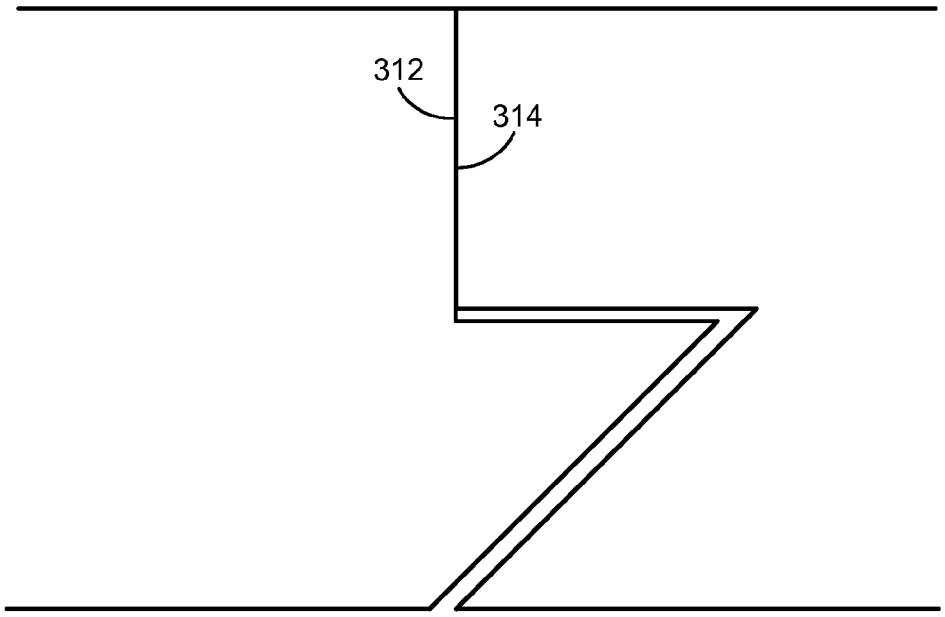
FIG. 4A shows a cross-section of two adjacent floor planks including a wedge and wedge shaped slot connection joint.
Figure 4B:
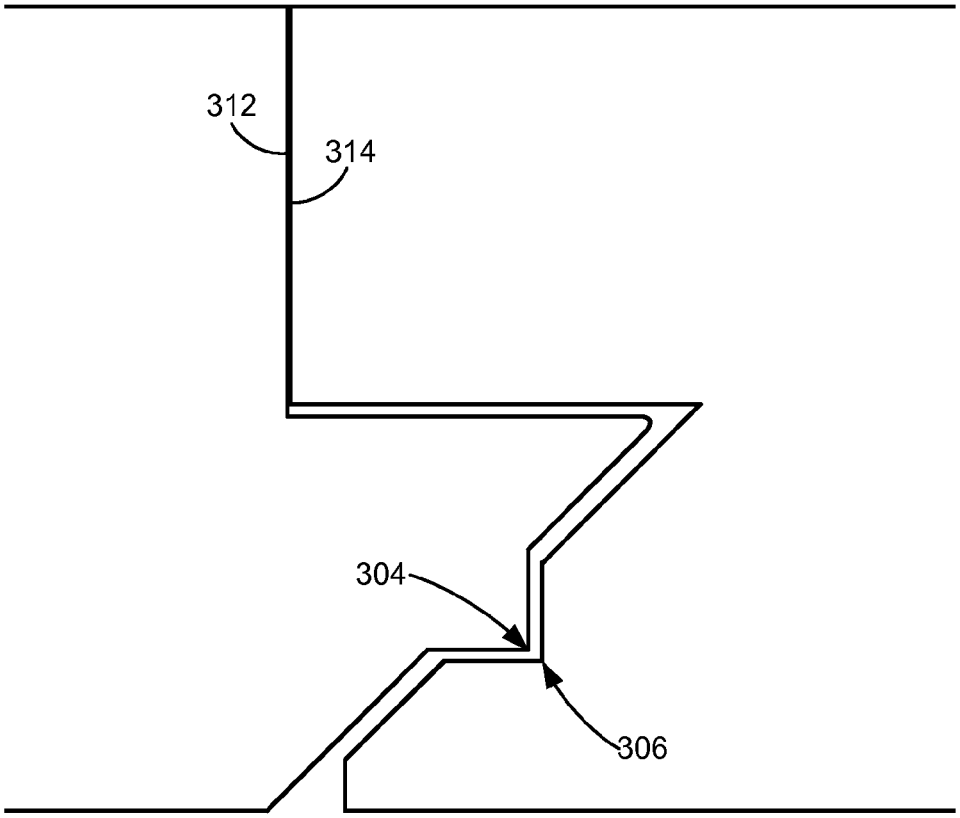
FIG. 4B shows a cross-section of two adjacent floor planks including a wedge and wedge shaped slot connection joint further including a cleat and a cleft.

The embodiments in FIGS. 3A and 3B include an upper portion 315 of the plank 100 including two contact sides 312, 314, one on the wedge 300 side and one on the wedge shaped slot 302 side. The upper portion 315 of the plank 100 corresponds to the wear layer of the plank. In embodiments, the wear layer comprises around 30%-70% of the total thickness of the plank, for example the for an overall plank thickness of 13 mm the wear layer may be 6 mm. In the example shown the wear layer is about 50% of the total thickness of the plank. The contact side 312 on the wedge side of a first plank is configured to abut against a contact side 314 on slot side of a second plank installed adjacent to the first plank, as shown in FIGS. 4A 4B. The embodiments shown include contact sides that are generally perpendicular to the top side of the plank and therefore generally vertical when installed as flooring, however in embodiments the contact sides may be of different shapes and positioned at various angles relative to the top side.

The wedge 300 shown in the embodiments in FIGS. 3A and 3B includes a upwardly facing side 310 on a top side of the wedge extending away from a first terminal position 317 of the contact side 312 toward a protruding tip 308, and an outwardly angled side 316 extending at an obtuse angle from the bottom side 104 of the plank toward the protruding tip 308. In embodiments the protruding tip 308 may be rounded, as shown in FIG. 3B, which creates a smooth guide to prevent the tip from catching on a portion of an adjacent plank during installation. Further, a corner 319 between the bottom side 104 of the plank and the outwardly angled side 316 may be rounded or chamfered.

Figure 3C:
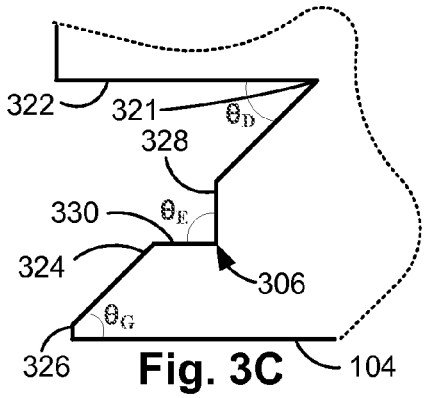
FIG. 3C shows a detailed portion of the slot of FIG. 3B.
Figure 3D:
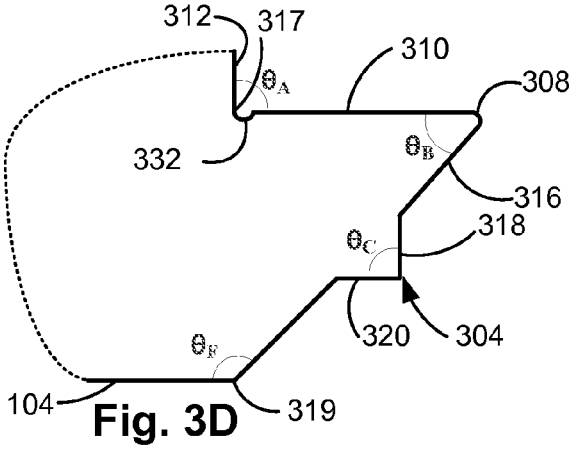
FIG. 3D shows a detailed portion of the wedge of FIG. 3B.

In the embodiments the wedge 300 may include a protrusion on the outwardly angled side 316. FIG. 3B shows the wedge 300 including a protrusion in the form of a cleat 304 located proximate to a middle portion of the outwardly angled side 316. In this embodiment the cleat 304 is generally triangular in shape and includes two sides, a vertical cleat side 318 and a horizontal cleat side 320, as shown in FIG. 3D. In embodiments the sides of the cleat may be straight, angled or curved, and additionally in embodiments the cleat may have any number of one or more sides, for example a single curved side forming a generally semi-circular cleat as shown in FIG. 6E. In embodiments a recess 332 may be formed at the first terminal position 317 to provide a space to accommodate the head of a fastener, for example a nail, as shown in FIG. 3D.

The wedge shaped slot 302 shown in the embodiments in FIGS. 3A and 3B includes a horizontal downward facing side 322 and an inwardly angled side 324. The wedge shaped slot 302 is configured to be received by a wedge 300 of an adjacent plank and is sized and shaped to be substantially complementary to a wedge 300. The inwardly angled side 324 extends at an acute angle from the bottom side 104 of the plank toward the top side 102 and terminates at the horizontal downward facing side 322. The horizontal downward facing side 322 extends from a second terminal position 323 of the slot side contact side 314 to the end of the inwardly angled side 324 at position 321. Embodiments of connection joints may include a swell relief 326 located at an end portion 325 of the inwardly angled side 324 and adjacent to the bottom side 104. The swell relief 326 provides a relief expansion space to allow a floor plank to swell and expand, for example in a high moisture environment.

In the embodiment shown in FIG. 3B the slot 302 includes a cleft 306 located on a middle portion of the inwardly angled side 324, dividing the inwardly angled side into multiple portions. The cleft 306 is generally triangular in shape and includes two sides, a vertical cleft side 328 and a horizontal cleft side 330, as shown in FIG. 3C. The shape, size and location of the cleft is configured to be complementary to a cleat 304 of a plank installed adjacent to the plank with the slot 302 and cleft 306 as shown in FIG. 4B.

In embodiments, the angles between the plurality of sides of the wedge, cleat, cleft, and slot different than what is show in FIGS. 3A and 3B. Angle A ($\theta_A$) shown in FIG. 3D is located between the contact side 312 and the upwardly facing side 310 and may range from 30° to 150°, such as 90°, as shown in FIG. 3D. Angle B ($\theta_B$) shown in FIG. 3D is located between the upwardly facing side 310 and the inwardly angled side 316 and may range from 10° to 80°, such as 45°, as shown in FIG. 3D. Angle C ($\theta_C$) shown in FIG. 3D is located between the vertical cleat side 318 and the horizontal cleat side 320 and may range from 10° to 170°, such as 90°, as shown in FIG. 3D. Angle D ($\theta_D$) shown in FIG. 3C is located between inwardly angled side 324 and the downward facing side 322. Since the slot 302 is configured to be received by the wedge 300, angle D can be identical or substantially identical, within a few degrees, to angle B of the wedge. Angle D can therefore range from 10° to 80°, such as 45°, as shown in FIG. 3C. Angle E ($\theta_E$) shown in FIG. 3C is located between the vertical cleft side 328 and the horizontal cleft side 330. Since the cleft 306 is configured to be complementary to the cleat 304, angle E can be identical or substantially identical, within a few degrees, to angle C. It can range from 10° to 170°, such as 90°, as shown in FIG. 3C. Angle F ($\theta_F$) shown in FIG. 3D is located between the bottom side 104 and the outwardly angled side 316 is an obtuse angle between 90° and 180°, such as 135°, as shown in FIG. 3D. Angle G ($\theta_G$) shown in FIG. 3C is an acute angle located between the bottom side 104 and the inwardly angled side 324. Since the slot 302 is configured to be complementary to the wedge 300, angle G can be identical or substantially identical, within a few degrees, to the complementary angle of angle F. It can range between 0° and 90°, such as 45°, as shown in FIG. 3C.

The wedge 300 shown in the embodiments in FIGS. 3A and 3B is configured to act as a guide to receive a complementary wedge shaped slot 302 of an adjacent floor plank that is installed next to the floor plank with the wedge 300. In embodiments, when a first plank is installed adjacent to a second plank the contact side 312 of the first plank is in contact with the contact side 314 of the second plank, however one or more sides of the wedge 300 of a first plank may be separated by a small gap from one or more complementary sides of the slot 302 of the adjacent second plank. The embodiments in FIGS. 4A and 4B show a gap between all sides of the wedge of a first plank and the slot of a second plank. The relative size of the gap shown in FIGS. 4A and 4B is for illustrative purposes and in practice the gaps may be larger or smaller relative to the dimensions of the cross-section of the planks and further may vary in size between different sets of complementary sides of the wedge and slot.

In embodiments, in order to form a gap between complementary sides of the wedge and slot the dimensions of other sides need to be set accordingly. For example, to create a vertical gap between the upwardly facing side 310 of the wedge of a first plank and the downward facing side 322 of the slot of a second plank the contact side 314 of the second plank is made shorter than the contact side 312 of the first plank as is shown in FIGS. 4A and 4B. This gap between these two horizontal sides prevents the sides from hitting or rubbing each other during the process of installation and further provides minor adjustment space for better surface alignment. The other sides of the wedge and slot may be configured to form similar gaps with similar benefits.

FIG. 5A-D shows examples of separation of different embodiments of connection joints as a result of shrinking of the planks. In the examples shown a separation is formed between an affixed wedge side of a first plank and an un-affixed slot side of a second plank. The amount of separation, in addition to pre-existing gaps, between complementary sides is dependent on the angle of the sides relative to the direction of separation. With shrinking in the horizontal direction, the horizontal separation of the completely vertical sides is the greatest and the separation between angled sides decreases with an increasing horizontal component of the angle of the sides. Where the complementary sides are completely horizontal only little separation occurs during horizontal shrinking.

Figure 5B:
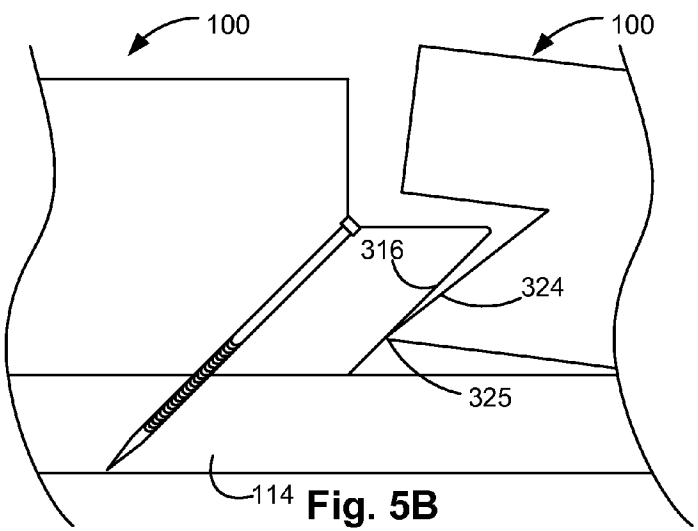
FIG. 5B shows a cross-section of two adjacent floor planks including edges with embodiments of a connection joint separated with the un-affixed edge displaced in the vertical direction.
Figure 5A:
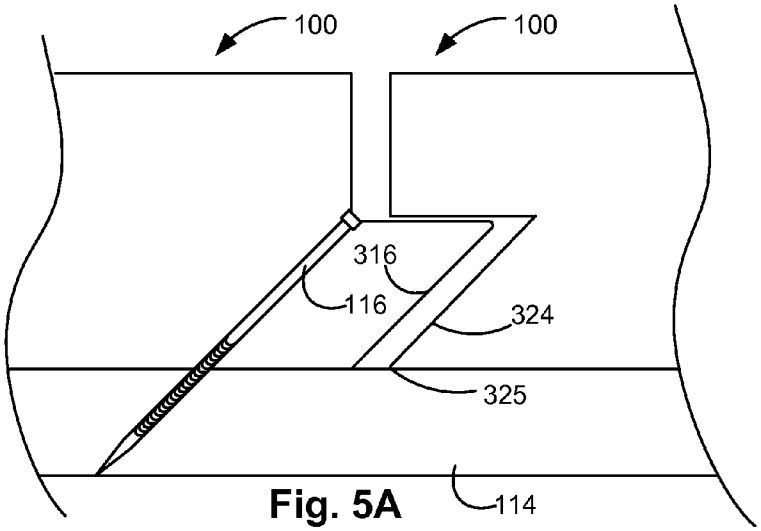
FIG. 5A shows a cross-section of two adjacent floor planks including edges with embodiments of a connection joint separated due to contraction of one or more planks.

A gap between inward angled side 324 and the outward angled side 316 is formed when the horizontal separation occurs as shown in FIG. 5A, the inwardly angled side 324 of the un-affixed slot side of the second plank is no longer securely held against the sub-floor by outwardly angled side 316 of the affixed wedge side of the first plank. If the slot side of the second plank is forced in an upward direction for example in a case where the planks are on an uneven sub-floor and a person steps on the wedge side of the second plank causing the slot side to rise, the slot side of the second plank will move in a vertical direction until the end portion 325 of the inwardly angled side 324 contacts the outwardly angled side 316 of the wedge of the first plank. The amount of vertical movement generally corresponds to the vertical separation between the inwardly angled side 324 of the slot of the second plank and the outwardly angled side 316 of the wedge 300 of the first plank, as shown in FIG. 5B. For a given horizontal separation the vertical separation is dependent on angles B and D. Smaller angles B and D correspond to smaller vertical separation for a given horizontal separation. Therefore, embodiments with smaller angles B and D will allow less vertical movement for a given horizontal separation than embodiments with larger angles B and D.

Figure 5D:
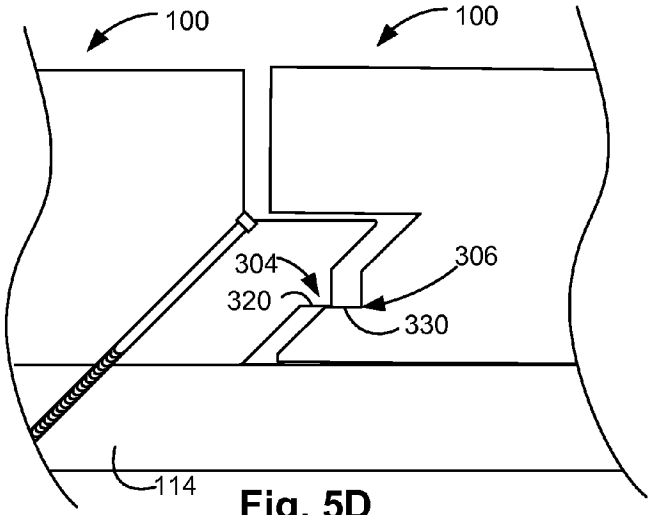
FIG. 5D shows a cross-section of two adjacent floor planks including edges with the embodiments of the connection joint with the un-affixed edge prevented from substantial vertical displacement due to the cleat and cleft.
Figure 5C:
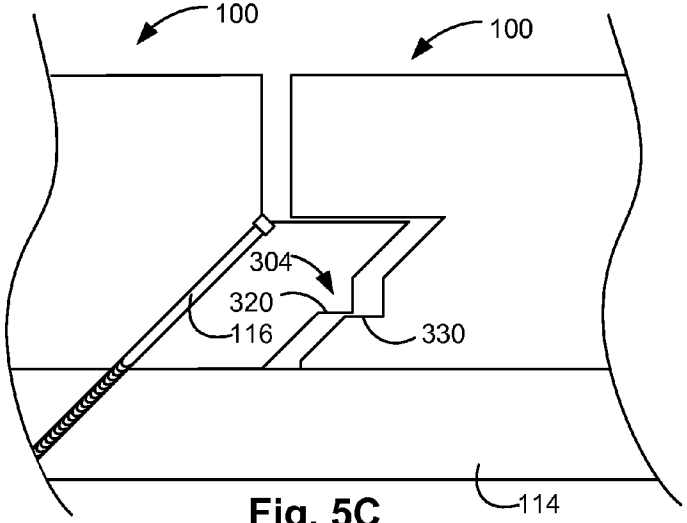
FIG. 5C shows a cross-section of two adjacent floor planks including edges with the embodiments of the connection joint shown in FIG. 4B separated due to contraction of one or more planks.

In the embodiment shown in FIGS. 5C and 5D the upward movement of the second plank is additionally prevented by the horizontal cleat side 320 of the cleat 304 of the wedge 300 of the first plank and the horizontal side 330 of the cleft 306 of the slot 302 of the second plank. When an overlap of the horizontal cleat side 320 and horizontal cleft sides 330 exists the vertical movement of the second plank is limited by the amount of separation of these sides. As discussed above, since these are horizontal sides the vertical separation between these sides is not dependent on the horizontal separation caused by shrinking and therefore the vertical separation between these sides is equal to the vertical gap present between the two sides prior to separation of the planks caused by shrinking. It is beneficial to have horizontal cleat and cleft sides with sufficient lengths to maintain overlap at maximum shrinking of the planks to prevent vertical movement of the second plank. In an example embodiment, the floor plank may be 13 mm thick, with an 6 mm wear layer, a 7 mm bottom portion including the wedge and slot, and a horizontal cleat and cleft side each be about 1 mm. While in the embodiments shown the horizontal cleat and clefts sides are horizontal, in embodiments they may also be angled or have curved sides, or a combination of straight, angled or curved sides, and will still add similar benefits to the connection joint.

The surface coverings including embodiments of the connections joints may be installed in various ways. For example, floor planks can be installed using a fastener method as disclosed above, a glue-down method or a floating method. In a glue down method the planks may be glued down directly onto a subfloor, or the planks may be edge glued resulting in a glue-connected floating floor.

Figure 7A:
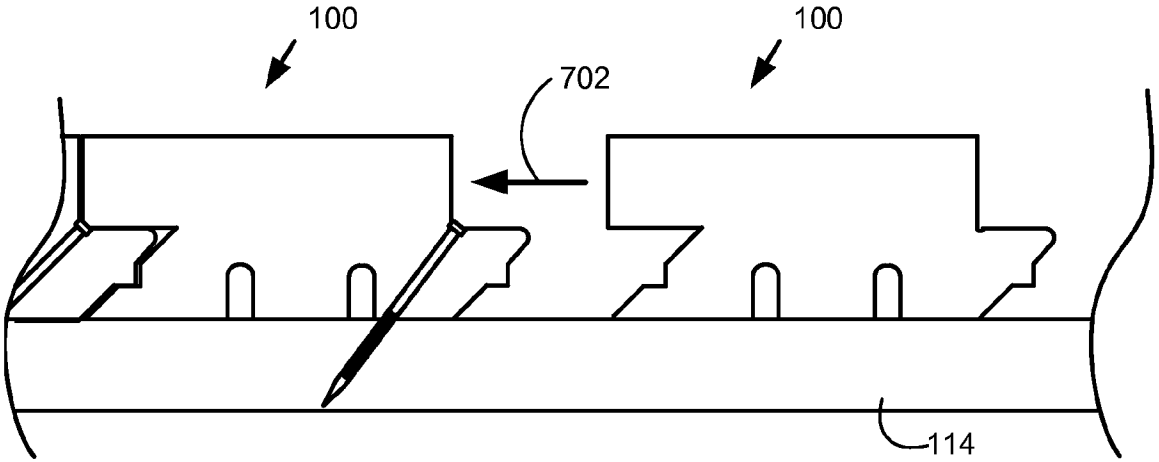
FIGS. 7A and 7B show cross-sections of two adjacent floor planks including edges with embodiments of a connection joint during an installation process.
Figure 7B:
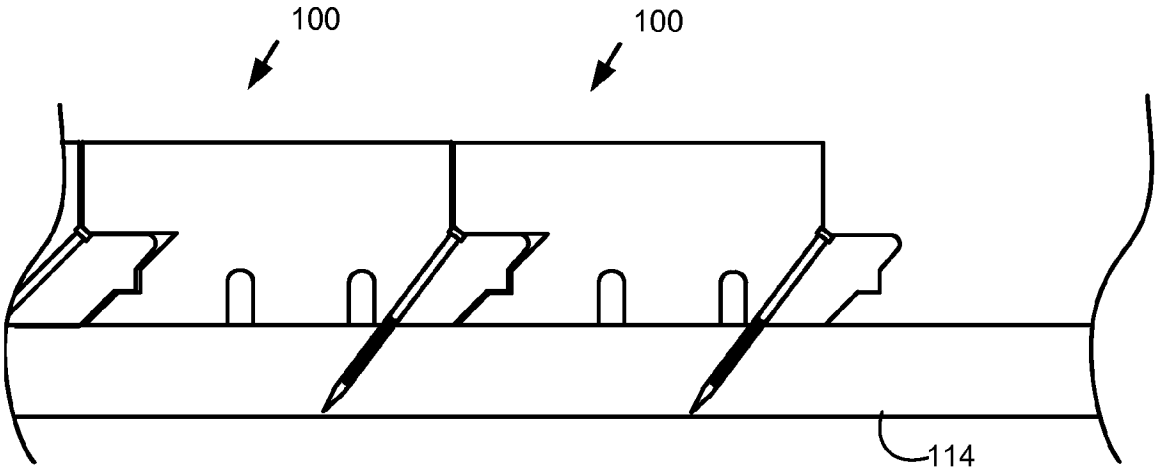

A method of installing floor planks 100 using a fastener method may include; nailing down a first row of planks along a guideline or straight wall with the wedge side facing the direction the floor covering is going to cover. Then either by face-nailing or nailing through the recess 332 of the wedge, fastening the first row of floor planks to a sub-floor 114. Then sliding 702 the slot side of a plank in the second row of planks horizontally along the sub-floor 114 toward the wedge side of the first row of floor planks, as shown in FIG. 7A. The protruding tip 308 of the wedge 300 of a first row plank 100 may guide the slots 302 of a second row plank as the second row plank slides into place. The second row plank is in place when the slot 302 of the second row plank is received by the wedge 300 of the first row plank and the contact side 312 of a first plank abuts the contact side 314 of the second plank, and the upwardly facing side 310 with the outwardly angled side 316 and the downward facing side 322 with the inwardly angled side 324 are also fully engaged. In embodiments the vertical cleat side 318 and the horizontal cleat side 320 of cleat 304 and the vertical cleft side 328 and the horizontal cleft side 330 of cleft 306 are also fully engaged, as is shown in FIG. 7B. During this horizontal sliding motion of the second row plank 100, the top side 102 of the second row plank is substantially on the same plane as the top side 102 of the first row plank 100. Once mated and before the second row plank 100 is affixed to the sub-floor 114 the plank is free to move in the horizontal direction away from the first row as the connection joint provides no resistance to movement in this direction. The second row plank 100 is then affixed to the sub-floor 114, in this example with a fastener 116. This process is repeated for each floor plank of additional rows.

Surface covering including embodiments of connection joints may be manufactured in a plurality of ways. For example, surface coverings may be manufactured from wooden planks from sawmills. Drying, planing and sanding processes may be performed to the wooden planks prior to performing cutting processes with various milling tools to form the features of the connection joints. For example, wooden floor planks with embodiments of connection joints may be manufactured using one or more milling processes to form wedges, slots, cleat, cleft, recesses, kerfs, bevels and swell reliefs. As shown in the embodiment in FIGS. 3A and 3B, the front joining plane 312 and the wedge 300 with the upward surface 310 and the bevel plane 316, may be formed along the entire length of one longitudinal side of the plank 100. The cleat 304 may be formed in the middle of the bevel plane 316. The rear joining plane 314 and the slot 302 with the downward surface 322 and the inclined plane 324 may be formed along the entire length of the opposite longitudinal side of the plank 100. The cleft 306 may be formed in the middle of the inclined plane 324. The swell relief 326 may be formed along the entire length of the bottom side of the plank 100.

Figure 6A:
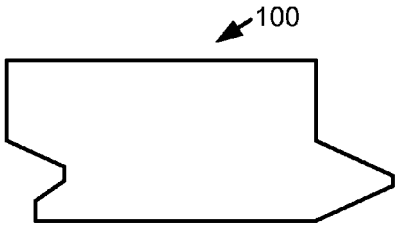
FIGS. 6A-L shows cross-sections of floor planks including edges with different embodiments of connection joints.

FIG. 6A is a cross section view of a plank 100 with an embodiment of a connection joint according the present technology. The embodiment includes a triangular shape wedge and slot profile.

Figure 6B:
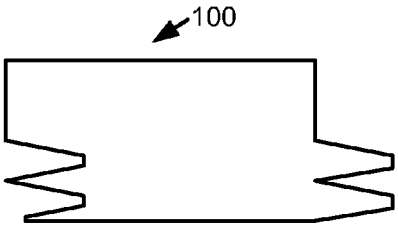

FIG. 6B is a cross section view of a plank 100 with an embodiment of a connection joint according the present technology. The embodiment includes a double triangular shape wedge and slot profile.

Figure 6C:
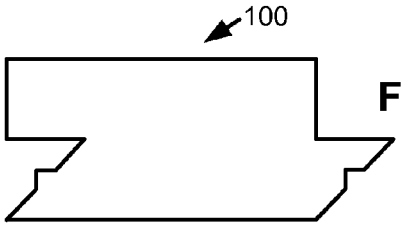

FIG. 6C is a cross section view of a plank 100 with an embodiment of a connection joint according the present technology. The embodiment includes a wedge and wedge shaped slot similar to embodiments disclosed above wherein the wedge includes a cleft and the wedge shaped slot includes a cleat.

Figure 6D:
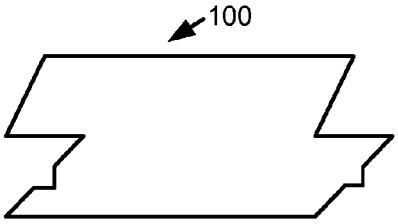
Figure 6E:
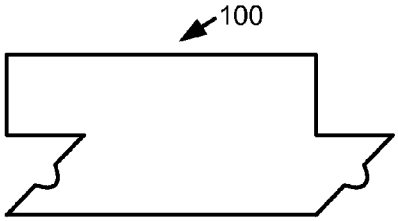

FIG. 6D is a cross section view of a plank 100 with an embodiment of a connection joint according the present technology. The embodiment includes tilted contact sides. The angle of the tilted contact sides can range from 10° to 170°.

FIG. 6E is a cross section view of a plank 100 with an embodiment of a connection joint according the present technology. The embodiment including a wedge and wedge shaped slot similar to embodiments disclosed further including a cleat on the wedge and a cleft in the wedge shaped slot formed in a half circle shape profile. In embodiments the cleat and cleft can be in various shapes. Further the cleft may be of a first shape and the cleat a second shape wherein the cleft is configured to receive the differently shaped cleat and have similar functions as the cleat and cleft disclosed above.

Figure 6F:
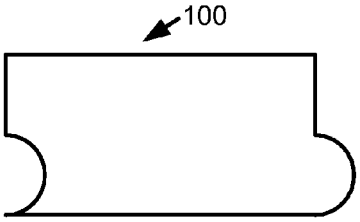

FIG. 6F is a cross section view of a plank 100 with an embodiment of a connection joint according the present technology. The connection joint including a half circular shape profile for a wedge and slot.

Figure 6G:
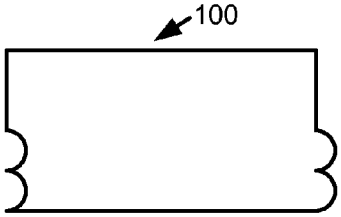

FIG. 6G is a cross section view of a plank 100 with an embodiment of a connection joint according the present technology. The connection joint including a double half circular shape wedge and slot.

Figure 6H:
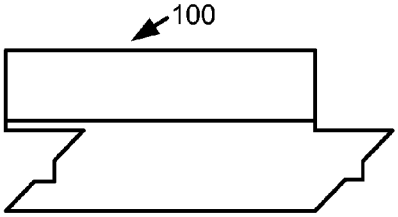
Figure 6I:
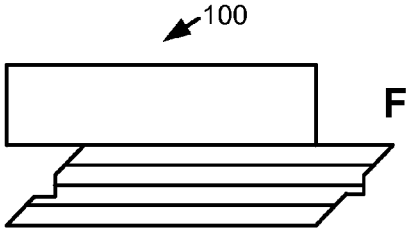
Figure 6J:
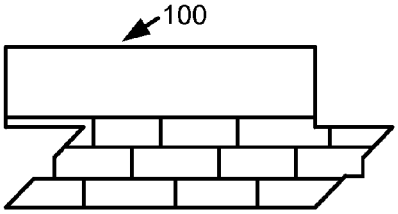

FIGS. 6H, 6I and 6J are cross sectional views of planks 100 with embodiments of connection joints according the present technology. The connection joints may be formed on multi-layer planks. The cross-section includes a top section and a bottom section made of the same or different material. Each portion may be construction of one or more layers. For example, the embodiment of FIG. 6H may include a solid wooden top portion and a vertically laminated wooden bottom portion, the embodiment of FIG. 6I may include a solid wooden top portion and a plywood bottom portion, and the embodiment of FIG. 6J may include a solid wooden top portion and a composite bottom portion. Embodiments with multiple portions provide the benefit of a strong top surface that is able to be refinished multiple times and a less expensive bottom portion that may also be more environmentally friendly by using non-wood materials.

Figure 6K:
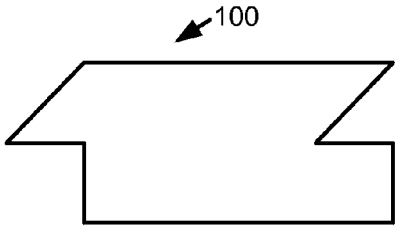

FIG. 6K is a cross section view of a plank 100 with an embodiment of a connection joint according the present technology. The connection joint including an inverted shape wedge and slot profile.

Figure 6L:
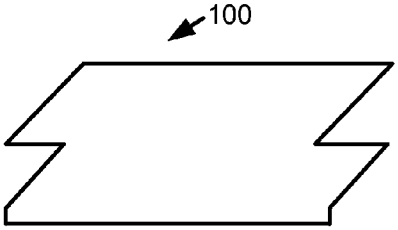

FIG. 6L is a cross section view of a plank 100 with an embodiment of a connection joint according the present technology. The connection joint including a slanted inverted shape wedge and slot profile.

While the present technology is disclosed by reference to the embodiments and examples detailed above, it is to be understood that these examples are intended in an illustrative rather than in a limiting sense. For example, while the present technology is particularly advantageous as use with floor coverings, embodiments of the connection joints may be used in other surface covering applications, including, but not limited to construction panels, such as housing indoor and outdoor frame panels, structural panels, subfloor panels, roofing panels, wall panels, ceiling panels, floor covering panels, decorative panels, decks and patio panels, furniture surfaces, shelving, partition panels, horizontal and vertical surfaces, table tops, counter tops, and other surface coverings or parts currently using tongue and groove connecting systems.

Further, while embodiments were disclosed in relation to a rectangular plank, such as the one shown in FIG. 2A, embodiments of the connection joints of the present technology may be used with various shaped panels including any combination of straight, angled or curves sides, for example panels in the shape of rectangles, squares, triangles, other polygons, arcs, circles and semi-circles. Further, the connection joints of the present technology may be used on adjacent panels that have different sizes, shapes and orientations, for example in parquet flooring. Further, the technology may be used with surface covering panels with top and bottom sides that are not flat, for example the tops and bottoms sides may be curved or include angles.

Further, embodiments of connection joints have been described using cross-sections including what may be referred to as a male side (e.g. wedge) and a female side (e.g. slot) of connection joints. In embodiments, a surface covering panel may include a single male or female of a connection joint. Further, a surface covering panel may include any combination of male and female sides of a plurality of connection joints. For example, the two edges of a four side floor plank may include complementary connection joints (e.g. male and female), identical connection joints (e.g. male and male), or different connection joints (e.g. male of first type of connection joint and female of second type of connection joint). Further one or more sides or edges of a panel may have no connection joints while other sides do include one or more connection joints.

Further, the embodiments of connection joints have been described using cross-sections to illustrate various functional aspects of different connection joints. The cross-sections may further include other functional or ornamental features of a plank. For example, the cross-section of a plank 100, may further include provides kerf cuts 334, along the bottom side 104, as shown in FIG. 3B. The kerf cuts may be formed along the entire length of the plank in the longitudinal direction for the purpose of dimensional stability. The kerf cuts can be formed by removing a predetermined amount of wood material from the lower portion of the plank with a milling process. The kerf cuts further provide a relief space to accommodate swell of floor plank when it is under high humidity environments. In addition, the kerfs also provide a space to accommodate excess glue in glue-down installations. Additionally ornamental features such as a bevel may be formed around the parameters of the top side 102 of a plank 100. The bevel improves the aesthetic appearance of installed wood floor planks by making any slight irregularities in thickness of floor planks less conspicuous.

The embodiments described and shown in the figures portray relative dimensions of cross sections of connection joints, however other embodiments may have different relative dimensions of the various components without departing from the scope of the technology.

Descriptions of embodiments of the present technology included wood as an example of a material that may be used to construct the connection joints. However, other materials and combinations of materials may alternatively be used including, metals, plastics, composites, bamboo, cork, fiberboard, coconut palm, particle board (e.g. MDF and HDF), and other natural, organic, recycled, or synthetic materials, or any other similar materials. Those in the art will understand that any suitable material, now known or hereafter developed, may be used in making the panels described herein. In embodiments including two or more layer engineered floors, the layers may be made from any combination of the conventional materials used in the surface covering product industry.

The following clauses describe aspects of various examples of connection joints for surface coverings such as floor coverings.

1. A floor plank comprising: a top side; a bottom side substantially parallel to the top side; a first edge extending from the top side to the bottom side comprising; a first contact side extending from the top side to a first terminal position between the top side and the bottom side; and a wedge shaped protrusion comprising; a first horizontal side extending from the first terminal position and substantially parallel to the top side; and a first angled side extending from the bottom side to the first horizontal side; wherein an angle formed between the bottom side and the first angled side is obtuse and an angle formed between the first horizontal side and the first angled side is acute; and wherein the first angled side includes a cleat locate along the first angled side and spaced apart from the bottom side and the first horizontal side.

2. The floor plank of clause 1, wherein the first contact side is substantially perpendicular to the top side and wherein the length of the first contact side is between 40% and 60% of the distance between the top side and bottom side.

3. The floor plank of clauses 1 or 2 wherein the cleat includes a horizontal cleat side substantially parallel to the first horizontal side.

4. The floor plank of clauses 1. 2. or 3 further comprising: a second edge extending from the top side to the bottom side comprising; a second contact side extending from the top side to a second terminal position between the top side and the bottom side; and a wedge shaped slot comprising; a second horizontal side extending from the second terminal position and substantially parallel to the top side; and a second angled side extending from the bottom side to the second horizontal side; wherein an angle formed between the bottom side and the second angled side is acute and the an angle formed between the second horizontal side and the second angled side is acute; wherein the second angled side includes a cleft located along the second angled side spaced apart from the bottom side and the second horizontal side.

5. The floor plank of clauses 1, 2, 3, or 4; wherein the cleft includes a horizontal cleft side substantially parallel to the second horizontal side.

6. The floor plank of clauses 4 or 5, wherein the first edge of the floor plank is complementary in shape to the second edge of the floor plank so that a second edge of a second floor plank having the same geometry as the floor plank is able to mate with the first edge of the floor plank and the top and bottom sides will align.

7. The floor plank of clauses 4, 5, or 6, wherein first edge of the floor plank is complementary in shape to the second edge of the floor plank so that a second edge of a second floor plank having the same geometry as the floor plank is able to mate with the first edge of the floor plank so that the first contact side of the first plank would abut the second contact side of the second plank and a gap would be formed between sides of the wedge shaped protrusion of the floor plank and sides of the wedge shaped slot of the second floor plank.

8. A floor plank comprising: a top side; a bottom side substantially parallel to the top side; a second edge extending from the top side to the bottom side comprising; a second contact side extending from the top side to a second terminal position between the top side and the bottom side; and a wedge shaped slot comprising; a second horizontal side extending from the second terminal position and substantially parallel to the top side; a second angled side extending from the bottom side to the second horizontal side; wherein an angle formed between the bottom side and the second angled side is acute and the an angle formed between the second horizontal side and the second angled side is acute; wherein the second angled side includes a cleft located along the second angled side spaced apart from the bottom side and the second horizontal side.

9. A method of forming a floor covering comprising; providing a first plank comprising; a first top side; a first bottom side substantially parallel to the first top side; a first edge extending from the first top side to the first bottom side comprising; a first contact side extending from the first top side to a first terminal position between the first top side and the first bottom side; and a wedge shaped protrusion comprising; a first horizontal side extending from the first terminal position and substantially parallel to the first top side; a first angled side extending from the first bottom side to the first horizontal side; wherein an angle formed between the first bottom side and the first angled side is obtuse and the an angle formed between the first horizontal side and the first angle side is acute; and wherein the first angled side includes a cleat located along the first angled side spaced apart from the bottom side and the first horizontal side; affixing the first plank to a sub-floor; providing a second plank comprising; a second top side; a second bottom side substantially parallel to the second top side; a second edge extending from the second top side toward the second bottom side; a second contact side extending from the second top side to a second terminal position between the second top side and the second bottom side; and a wedge shaped slot comprising; a second horizontal side extending from the second terminal position and substantially parallel to the second top side; a second angled side extending from the second bottom side to the second horizontal side; wherein an angle formed between the second bottom side and the second angled side is acute and the an angle formed between the second horizontal side and the second angled side is acute; and wherein the second angled side includes a cleft located along the second angled side spaced apart from the bottom side and the second horizontal side; and mating the first edge of the first plank with the second edge of the second plank so that the first and second contact sides abut.

10. The method of clause 9, wherein mating the first edge of the first plank with the second edge of the second plank comprises: placing the second plank on the sub-floor so that the second top side is on substantially a same plane as the first top side; and sliding the second plank toward the first plank.

11. The method of clauses 9 or 10, wherein the first contact side is substantially perpendicular to the first top side and wherein the length of the first contact side is between 40% and 60% of the distance between the top side and bottom side.

12. The method of clauses 9, 10 or 11, wherein the cleat is substantially triangular in shape and includes a horizontal cleat side substantially parallel to the first horizontal side; wherein the cleft includes a horizontal cleft side substantially parallel to the second horizontal side; and wherein the horizontal cleat and cleft sides overlap in a horizontal direction when the first and second contact sides abut.

13. The method of clauses 9, 10, 11, or 12, wherein mating the first edge of the first plank with the second edge of the second plank comprises; forming a gap between sides of the wedge shaped protrusion and slot when the first and second contact sides abut.

14. A method of manufacturing a floor plank comprising: accessing a panel having a top side and a bottom side substantially parallel to the top side; forming a first edge extending from the top side to the bottom side, the first edge comprising; a first contact side extending from the top side to a first terminal position between the top side and the bottom side; and a wedge shaped protrusion comprising; a first horizontal side extending from the first terminal position and substantially parallel to the top side; and a first angled side extending from the bottom side to the first horizontal side; wherein an angle formed between the bottom side and the first angled side is obtuse and the an angle formed between the first horizontal side and the first angled side is acute; and wherein the first angled side includes a cleat locate along the first angled side and spaced apart from the bottom side and the first horizontal side.

15. The method of clause 14, wherein the first contact side is substantially perpendicular to the top side and wherein the length of the first contact side is between 40% and 60% of the distance between the top side and bottom side.

16. The method of clauses 14 or 15, wherein the cleat includes a horizontal cleat side substantially parallel to the first horizontal side.

17. The method of clauses 14, 15, or 16, further comprising: forming a second edge extending from the top side to the bottom side, the second edge comprising; a second contact side extending from the top side to a second terminal position between the top side and the bottom side; and a wedge shaped slot comprising; a second horizontal side extending from the second terminal position and substantially parallel to the top side; a second angled side extending from the bottom side to the second horizontal side; wherein an angle formed between the bottom side and the second angled side is acute and the an angle formed between the second horizontal side and the second angled side is acute; wherein the second angled side includes a cleft locate along the second angled side and spaced apart from the bottom side and the second horizontal side.

18. The method of clause 17; wherein the cleft includes a horizontal cleft side substantially parallel to the second horizontal side.

19. The method of clause 18, wherein the cleat includes a horizontal cleat side substantially parallel to the horizontal cleft side.

20. The method of clauses 17 of 18, wherein the wedge shaped protrusion and wedge shaped slot have complementary shapes.

21. The floor plank of clause 1, wherein the first contact side is substantially perpendicular to the top side and wherein the length of the first contact side is between 30% and 70% of the distance between the top side and bottom side.

It is contemplated that modifications and combinations will readily occur to those skilled in the art, which modifications and combinations will be within the spirit of the invention and the scope of the following claims.

What is claimed is:

1. A floor plank for horizontal flooring assemblies comprising:

a top side;

a bottom side substantially parallel to the top side, wherein the floor plank is affixed to a horizontal surface with the bottom side contacting the horizontal surface;

a first edge extending from the top side to the bottom side comprising;

a first contact side extending from the top side to a first terminal position between the top side and the bottom side; and a wedge shaped protrusion comprising;

a first horizontal side extending from the first terminal position, facing toward the top side, and substantially parallel to the top side; and a first angled side extending from the bottom side to the first horizontal side, including a first portion extending from the bottom side, a second portion extending from the first horizontal side, and a cleat;

wherein an angle formed between the bottom side and the first portion of the first angled side is obtuse, an angle formed between the first horizontal side and the second portion of the first angled side is acute, and the first portion and second portion of the first angled side are coplanar; and wherein the cleat is located between the first and second portions of the first angled side and includes a horizontal cleat side extending from the first portion of the first angled side, substantially parallel to the first horizontal side, and forming an obtuse angle with the first portion of the first angled side;

wherein the first edge is configured to mate with a third edge, of a second floor plank affixed to the horizontal surface adjacent the floor plank, the third edge having a complementary shape to the first edge and includes a wedge shaped slot including a cleft; and wherein the second floor plank is configured to shrink in a direction away from the floor plank when affixed to the horizontal surface adjacent the floor plank, due to a change in temperature or humidity, creating a gap between the first edge and the third edge and the cleat of the first edge and cleft of the third edge are configured to maintain an overlap to limit vertical movement of the second plank when shrunk.

2. The floor plank of claim 1, wherein the first contact side is substantially perpendicular to the top side and wherein the length of the first contact side is between 40% and 60% of the distance between the top side and bottom side.

3. The floor plank of claim 1 wherein the cleat further includes a vertical cleat side extending from the second portion of the first angled side to the horizontal cleat side, substantially perpendicular to the first horizontal side and forming an obtuse angle with the second portion of the first angled.

4. The floor plank of claim 1 further comprising:

a second edge extending from the top side to the bottom side comprising;

a second contact side extending from the top side to a second terminal position between the top side and the bottom side; and a wedge shaped slot comprising;

a second horizontal side extending from the second terminal position, facing toward the bottom side, and substantially parallel to the top side; and a second angled side extending from the bottom side to the second horizontal side, including a third portion extending from the bottom side, a fourth portion extending from the second horizontal side, and a cleft;

wherein an angle formed between the bottom side and the third portion of the second angled side is acute, an angle formed between the second horizontal side and the fourth portion of the second angled side is acute, and the third and fourth portions of the second angled side are coplanar; and wherein the cleft is located between the third and fourth portions of the second angled side and includes a horizontal cleft side extending from the third portion of the second angled side, substantially parallel to the second horizontal side, and forming an obtuse angle with the third portion of the second angled side.

5. The floor plank of claim 4, wherein the cleft further includes a vertical cleft side extending from the fourth portion of the second angled side to the horizontal cleft side, substantially perpendicular to the second horizontal side and forming an obtuse angle with the fourth portion of the second angled side.

6. The floor plank of claim 4, wherein the first edge of the floor plank is complementary in shape to the second edge of the floor plank so that a second edge of a third floor plank having the same geometry as the floor plank is able to mate with the first edge of the floor plank to create an interlock in a direction perpendicular to the top sides of the floor plank and third floor plank and permit the third floor plank to freely move in a direction away from the floor plank and perpendicular to the first contact side.

7. The floor plank of claim 4, wherein the first edge of the floor plank is complementary in shape to the second edge of the floor plank so that a second edge of a third floor plank having the same geometry as the floor plank is able to mate with the first edge of the floor plank so that the first contact side of the first plank would abut the second contact side of the third floor plank and a gap would be formed between each side of the wedge shaped protrusion of the floor plank and each side of the wedge shaped slot of the third floor plank.

8. A floor plank for horizontal assemblies comprising:

a top side;

a bottom side substantially parallel to the top side, where the floor plank is affixed to a horizontal surface with the bottom side contacting the horizontal surface;

a second edge extending from the top side to the bottom side comprising;

a second contact side extending from the top side to a second terminal position between the top side and the bottom side; and a wedge shaped slot comprising;

a second horizontal side extending from the second terminal position, facing toward the bottom side, and substantially parallel to the top side;

a second angled side extending from the bottom side to the second horizontal side, including a third portion, a fourth portion and a cleft;

wherein an angle formed between the bottom side and the third portion of the second angled side is acute, an angle formed between the second horizontal side and the fourth portion of the second angled side is acute, and the third and fourth portions of the second angled side are coplanar; and wherein the cleft is located between the third and fourth portions of the second angled side and includes a horizontal cleft side extending from the third portion of the second angled side, substantially parallel to the second horizontal side, and forming an obtuse angle with the third portion of the second angled side;

wherein the second edge is configured to mate with a third edge, of a second floor plank affixed to the horizontal surface adjacent the floor plank, the third edge having a complementary shape to the second edge and includes a wedge shaped protrusion including a cleat; and wherein the floor plank is configured to shrink in a direction away from the second floor plank when affixed to the horizontal surface adjacent the second floor plank, due to a change in temperature or humidity, creating a gap between the second edge and the third edge and the cleat of the third edge and cleft of the second edge are configured to maintain an overlap to limit vertical movement of the floor plank when shrunk.

9. A method of forming a floor covering comprising;

providing a first plank comprising;

a first top side;

a first bottom side substantially parallel to the first top side;

a first edge extending from the first top side to the first bottom side comprising;

a first contact side extending from the first top side to a first terminal position between the first top side and the first bottom side; and a wedge shaped protrusion comprising;

a first horizontal side extending from the first terminal position, facing toward the first top side, and substantially parallel to the first top side;

a first angled side extending from the first bottom side to the first horizontal side, including a first portion extending from the first bottom side, a second portion extending from the first horizontal side, and a cleat;

wherein an angle formed between the first bottom side and the first portion of the first angled side is obtuse, an angle formed between the first horizontal side and the second portion of the first angle side is acute, and the first portion and second portion of the first angled side are coplanar; and wherein the cleat is located between the first and second portions of the first angled side and includes a horizontal cleat side extending from the first portion of the first angled side, substantially parallel to the first horizontal side, and forming an obtuse angle with the first portion of the first angled side;

affixing the first bottom side of the first plank to a sub-floor;

providing a second plank comprising;

a second top side;

a second bottom side substantially parallel to the second top side;

a second edge extending from the second top side toward the second bottom side comprising;

a second contact side extending from the second top side to a second terminal position between the second top side and the second bottom side; and a wedge shaped slot comprising;

a second horizontal side extending from the second terminal position, facing toward the second bottom side, and substantially parallel to the second top side;

a second angled side extending from the second bottom side to the second horizontal side, including a third portion extending from the second bottom side, a fourth portion extending from the second horizontal side, and a cleft;

wherein an angle formed between the second bottom side and the third portion of the second angled side is acute, an angle formed between the fourth portion of the second horizontal side and the second angled side is acute, and the third and fourth portions of the second angled side are coplanar; and wherein the cleft is located between the third and fourth portions of the second angled side and includes a horizontal cleft side extending from the third portion of the second angled side, substantially parallel to the second horizontal side, and forming an obtuse angle with the third portion of the second angled side;

mating the first edge of the first plank with the second edge of the second plank by placing the bottom side of the second plank on the sub-floor, so that the second top side is substantially coplanar with the first top side, and sliding the second plank along the sub-floor toward the first plank, while maintaining the first and second top sides being substantially coplanar, so that the first and second contact sides abut; and affixing a side of the second plank, opposite the second edge of the second plank, to the sub-floor;

wherein the second plank is configured to shrink in a direction away from the first plank when affixed to the sub-floor, due to a change in temperature or humidity, creating a gap between the first edge and the second edge and the cleat of the first edge and cleft of the second edge are configured to maintain an overlap to limit vertical movement of the second plank when shrunk.

10. The method of claim 9, wherein the first contact side is substantially perpendicular to the first top side and wherein the length of the first contact side is between 40% and 60% of the distance between the top side and bottom side.

11. The method of claim 9, wherein the cleat is substantially triangular in shape and further includes a vertical cleat side extending from the second portion of the first angled side to the horizontal cleat side, and substantially perpendicular to the first horizontal side;

wherein the cleft further includes a vertical cleft side extending from the fourth portion of the second angled side to the horizontal cleft side, and substantially perpendicular to the second horizontal side; and wherein the horizontal cleat and cleft sides overlap in a horizontal direction when the first and second contact sides abut to create an interlock in a direction perpendicular to the top sides of the first plank and second plank and permit the second plank to freely move in a direction away from the first plank and perpendicular to the first contact side.

12. The method of claim 9, wherein mating the first edge of the first plank with the second edge of the second plank comprises;

forming a gap between sides of the wedge shaped protrusion and slot when the first and second contact sides abut;

wherein during mating the cleat of the first plank is able to not contact the cleft of the second plank.

* * * * *